US010480209B2

(12) United States Patent
Johnson

(10) Patent No.: US 10,480,209 B2
(45) Date of Patent: Nov. 19, 2019

(54) NON-INJURIOUS RESTRAINT TYPE FORM OF FENCING

(71) Applicant: Edward Johnson, Sumter, SC (US)

(72) Inventor: Edward Johnson, Sumter, SC (US)

( * ) Notice: Subject to any disclaimer, the term of this patent is extended or adjusted under 35 U.S.C. 154(b) by 285 days.

(21) Appl. No.: 15/789,964

(22) Filed: Oct. 21, 2017

(65) Prior Publication Data

US 2019/0119947 A1 Apr. 25, 2019

(51) Int. Cl.
*E04H 17/00* (2006.01)
*E04H 17/14* (2006.01)

(52) U.S. Cl.
CPC ..... *E04H 17/003* (2013.01); *E04H 17/1413* (2013.01)

(58) Field of Classification Search
CPC .... E04H 17/003; E04H 17/14; E04H 17/1413
See application file for complete search history.

(56) References Cited

U.S. PATENT DOCUMENTS 5,054,955 A * 10/1991 Habernig ..... E01F 9/629 256/19
6,601,245 B2 * 8/2003 Weiss ..... E04H 4/144 182/106
9,228,372 B2 * 1/2016 Bertato ..... E04H 17/1421
2013/0292622 A1 * 11/2013 Waite ..... E04F 11/1804 256/65.01

* cited by examiner

*Primary Examiner* — Jonathan P Masinick
(74) *Attorney, Agent, or Firm* — Melissa B Neely

(57) ABSTRACT

The invention addressed in this application is non-injurious restraint type form of fencing designed to be used a perimeter or security fence. The fence is constructed of hollow polymer tubes arranged in horizontal rows affixed to a vertical post. The hollow tubular horizontal fence rails contain fibers that are coated with a moisture cured adhesives and the fibers are secured at one end to the end cap of the tubes. The tubes are sealed and slightly pressurized with a dry inert gas, so that upon breakage of the tubes by a person attempting to scale the fence, the fibers are expelled out of the tubes and entangle the would be climber. The tubes are constructed of a brittle material, like polystyrene, or material which will become brittle upon treatment with ultra violet (UV) radiation or heat.

5 Claims, 3 Drawing Sheets

NON-INJURIOUS RESTRAINT TYPE FORM OF FENCING

CROSS REFERENCE TO RELATED APPLICATIONS

Not Applicable

STATEMENT REGARDING FEDERALLY SPONSORED RESEARCH OR DEVELOPMENT

This invention was not made by an agency of the United States Government nor under a contract with an agency of the United States Government.

THE NAME OF THE PARTIES TO JOINT RESEARCH AGREEMENT

Not Applicable.

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable

BACKGROUND OF THE INVENTION

Field of the Invention

The present invention is directed to a type of security fencing that would capture and hold a would be trespasser without causing injury to the trespasser.

Walls and fences have been used for centuries to restrict the free movement of people or animals across land. Agricultural fencing is used on farms and ranches to keep livestock in certain areas. Boundary fencing is often used to demarcate a piece of real property. Perimeter or security fencing is used to prevent trespassing onto private property or public property where access needs to be restricted such as a military base.

Security or perimeter fencing is often topped with materials designed to cause injury to deter would be trespassers from scaling the fence. Materials such as broken glass, spikes, barbed wire, razor wire and concertina wire are often affixed at the top of the fence to discourage would be climbers by either the threat of or the actual infliction of bodily injury. A particularly daunting security fence is constructed by string concertina wire coils between metal pickets, such a fence serves not only as a deterrent but would also restrain a person attempting to cross the fence by virtue of the person become tangled in the wire coils. However, the person attempting the crossing has a high probability of being injured by the barbed wire or razor wire used to construct the concertina coils. The present invention is designed to prevent the would be climber from scaling the fence by capturing and restraining the trespasser without causing bodily injury.

The present invention consists of hollow tubes arranged horizontally and affixed to stationary vertical posts to form a fence. The tubes are constructed of a brittle material like polystyrene or a material which becomes brittle upon treatment with heat or ultra violet radiation (UV). The interior of the tubes contain individual fibrous strands coated with an adhesive which cures when exposed to the moisture in air. The fibrous containing fence tubes are slightly pressurized with an inert gas.

When a person attempts to scale the fence described in the above paragraph, the brittle horizontal tubes will break and expel the adhesive coated fibers onto the individual attempting to scale the fence. The would be climber becomes ensnared in the adhesive coated fibers and thus restrained until security personal can arrive on the scene of the attempted break in.

Description of Related Art

The Fence Rail and Bracket System (U.S. Pat. No. 9,228,372, issued Jan. 5, 2016 to Maurizio Bertato) describes a fencing system which uses vertical posts and horizontal fence rails formed of hollow rectangular tubular constriction. The Bertato invention describes a unique method for formation of a standard barrier type fence. Although the present invention also utilizes hollow tubes for the horizontal fence rails, it differs significantly from the Bertato invention. The horizontal fence rails of the present invention are designed to be brittle upon final installation and thus not support the weight of a person attempting to climb the fence. Additionally, the present invention includes adhesive coated fibers sealed inside the hollow horizontal fence rails that are present to ensnare and restrain the would be climber when the hollow tubes are broken in the attempt to scale the fence.

BRIEF SUMMARY OF THE INVENTION

Perimeter or security fences are used to present entry onto public or private property. The fence is often topped with materials designed to cause injury to deter would be trespassers from scaling the fence. Materials such as broken glass, spikes, barbed wire, razor wire and concertina wire are often affixed at the top of the fence to discourage would be climbers by either the threat of or the actual infliction of bodily injury. A particularly daunting security fence is constructed by string concertina wire coils between metal pickets, such a fence serves not only as a deterrent but would also restrain a person attempting to cross the fence by virtue of the person become tangled in the wire coils. However, the person attempting the crossing has a high probability of being injured by the barbed wire or razor wire used to construct the concertina coils. The present invention is designed to prevent the would be climber from scaling the fence by capturing and restraining the trespasser without causing bodily injury.

The fence is constructed in a typical manner by affixing horizontal fence rails to a vertical post which has been inserted partially into the ground. The horizontal fence rail is affixed to the vertical post by means of a circular clamp affixed to the vertical post and surrounding the circumference of the horizontal rail. The unique feature of this invention is the construction of the horizontal fence rail.

The horizontal fence rail is of hollow tubular construction. The interior of the fence rail contains a number of fibers that have been coated with a moisture cured adhesive. The tubes are sealed and slightly pressurized with a dry inert gas to prevent the curing of the adhesive. One end of the fibers have been affixed to the sealed end of the tube. The tubes are further constructed of a brittle material such as polystyrene or a material which becomes brittle upon exposure to UV radiation or a heat source.

When a would be trespasser attempts to scale the fence to gain access to the property protected by the fence, the horizontal fence rails will fracture and expel the adhesive coated fibers onto the climber, thus ensnaring climber. As the fibers are connected at one end to the fence, the ensnared climber is restrained and unable to vacate the premises. The potential for injury to the ensnared trespasser is much less than perimeter fencing that utilizes concertina wire.

DETAILED DESCRIPTION OF THE INVENTION

Figure 1:
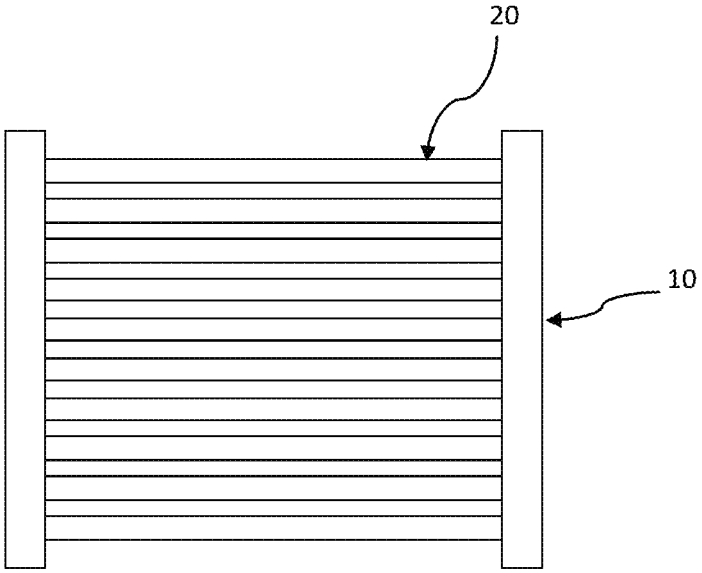
FIG. 1 displays a section of fencing comprised of support post to which the tubes containing adhesive coated fibers is attached.

The invention addressed in this application is non-injurious restraint type form of fencing designed to be used a perimeter or security fence. The fence is constructed of hollow polymer tubes (20) arranged in horizontal rows affixed to a vertical post (10). The hollow polymer tubes (20) , which may be referred to as fence rails, contain fibers (30) coated with a moisture cured adhesives which are secured at one end to the end cap of the tubes (21). The tubes (20) are sealed and slightly pressurized with a dry inert gas, so that upon breakage of the tubes the fibers (30) are expelled out of the tubes. The tubes (20) are constructed of a brittle material, like polystyrene, or material which will become brittle upon treatment with ultra violet (UV) radiation or heat.

The vertical posts (10) may be constructed to wood, metal, or plastic. Commercial available fence posts may be used for the construction of the fencing system described in this application.

The horizontal fence rails (20) are formed by hollow tubes. The hollow tubes (20) are affixed to the vertical posts (10). A typical method of affixation would be to utilize fence clamps. The number of horizontal tubes used for a section of fencing between two vertical posts (10) would be dependent upon the desired height of the fence and thus the height of the vertical posts (10). The horizontal fence rails (20) do not need to touch each other, but should be spaced sufficiently closed together to prevent someone from passing between adjacent horizontal fence rails (20).

It is desirable to construct the tubes comprising the horizontal fence rail (20) of a brittle material, such as polystyrene, or a material that will become brittle upon exposure to UV radiation or a heat source. The brittle nature of the horizontal fence rails is a requirement of this invention as the tubes need to fracture when a person attempts to scale the fence, releasing the adhesive coated fibers contained in the tubes. The UV or heat treatment can be performed on the tubes (20) after the fence system has been constructed for ease of installation.

The tubes (20) are sealed at both ends by an end piece (21) that is of a different material of construction than the remainder of the tube (20). The end pieces (21) are used to both seal the tubes and anchor the fibers (30) contained in the tubes, thus it is undesirable to have the end pieces (21) have the same brittle nature as the horizontal run of the tubes (20).

The tubes (20) may vary in length and diameter. A tube (20) may be three to twenty feet in length and one-half to two inches in diameter. Typical tubes are ten feet in length and one to two inches in diameter. However, these dimensions are provided to illustrate the preferred embodiment of the invention and the tubes are not limited to the lengths and diameter specified above.

The interior of tubes (20) contain numerous fibers (30) that have been coated with a moisture cured adhesive. The fibers (30) are secured on one end of the fiber (30) to the end pieces (21) of the tubes (20). When the tube (20) is fractured, such as when a person attempts to climb the fence), the fibers (30) are expelled from the tube into contact with the would be fence climber. The fibers (30) are coated with adhesive so that they might stick to and ensnare the climber. The fibers (30) are secured on one end of the fiber (30) to the tube end pieces (21) so that the climber cannot easily leave the premises.

The adhesive coated fibers (30) can be made of various materials, such as nylon, cotton, sisal, hemp or jute. The fibers (30) can be either rope or string like in nature (braided) or flat strips. The important features of the fibers (30) is the strength of the material and the ability to be impregnated with adhesive. The preferred embodiment of the invention utilizes string like strands of jute , but other materials can also be used.

The adhesive coated fibers (30) are coiled inside the hollow fence tubes (20). The length of the fibers (30) utilized may vary but it is important for a sufficient length be used to ensnare the climber.

The adhesive used to coat the fibers (30) should be one that will cure when exposed to the moisture in the air. A number of moisture cured adhesives (e.g., polyurethane, cyanoacrylate) are commercially available and suitable for use with this invention.

Although intended as a replacement for more conventional and potentially injurious types of security fencing such as concertina wire fences or chain link fences topped with barbed wire, the invention can be utilized with those types of fencing, either as an addition to the aforementioned conventional fencing or by topping the fence constructed in the manner described in this application with a section of barbed or razor wire.

A potential patent classifications for this invention include Class 256 Fences, Subclass 59 Rail.

Figure 2:
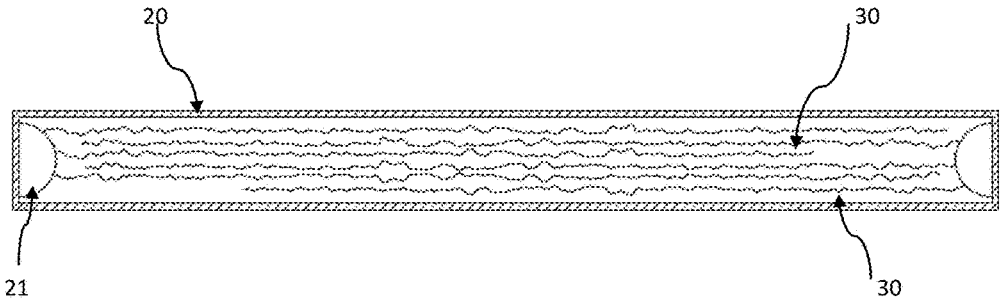
FIG. 2 is a cross section drawing of one of the tubes, illustrating the adhesive coated fibers. Note that the drawing does not show all of the adhesive coated fibers that would be contained within a single tube.
Figure 3:
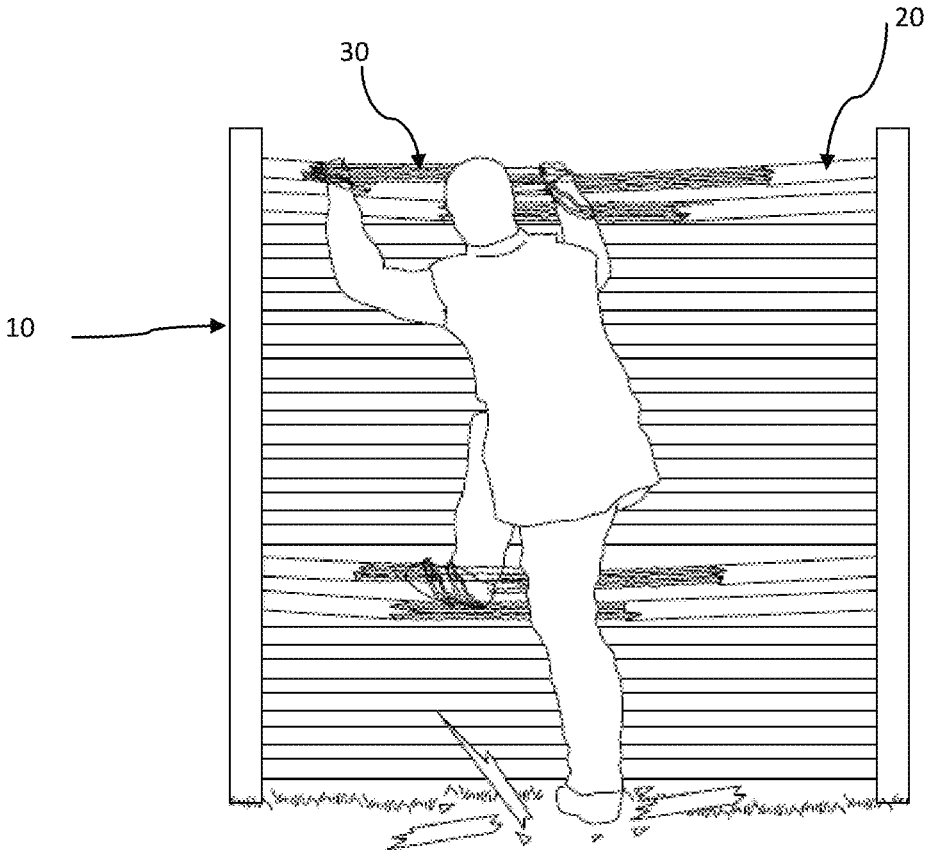
FIG. 3 illustrates a man attempting to scale a fence of the non-injurious restraint type form of fencing.

The present invention described above and illustrated in FIGS. 1 through 4 is visualized as the preferred embodiment of the invention. It is envisioned that this invention may be embodied in many different forms and should not be construed as limited to the embodiments set forth herein. It will be understood by those skilled in the art that changes in forms and details may be made without departing from the spirit and scope of the present application. It is therefore intended that the present invention not be limited to the exact forms and details described and illustrated herein, but falls within the scope of the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a stricture or feature that is disposed "adjacent" another feature may have portions that overlap or underlie the adjacent feature.

The invention claimed is:

1. A fencing system comprised of hollow polymer tubes arranged in horizontal rows affixed to vertical fence posts, the hollow polymer tubes contain fibers which are coated with a moisture cured adhesive where said fibers are secured at end to an end cap of the tubes, where said tubes are constructed of a brittle material or a material which will become brittle upon treatment with ultra violet radiation or heat and said tubes containing the adhesive coated fibers are sealed and pressurized with a dry inert gas, such that said adhesive coated fibers are expelled out of the tube upon breakage of said tube.

2. The fencing system as recited in claim 1, wherein said hollow polymer tubes are constructed of polystyrene.

3. The fencing system as recited in claim 1, wherein said hollow polymer tubes are constructed of a polymer which becomes brittle upon treatment with ultra violet radiation or heat.

4. The fencing system as recited in claim 1, wherein said hollow polymer tube is three to twenty feet in length and one-half to two inches in diameter.

5. The fencing system as recited in claim 1, where said adhesive coated fibers are made from nylon, cotton, sisal, hemp or jute.

* * * * *